United States Patent [19]

Booth

[11] 4,084,525

[45] Apr. 18, 1978

[54] METHOD OF FORMING A HERMETICALLY SEALED CONTAINER AND THE TOOLS USED THEREWITH

[75] Inventor: Morris A. Booth, Traverse City, Mich.

[73] Assignee: Swanco, Acme, Mich.

[21] Appl. No.: 582,371

[22] Filed: May 30, 1975

[51] Int. Cl.[2] ..... B21D 51/48

[52] U.S. Cl. ..... 113/1 K; 15/415 R; 30/441; 72/402; 113/120 BB; 113/121 A; 113/121 F; 220/67; 220/81 R

[58] Field of Search ..... 113/1 K, 120 BB, 1 E, 113/1 F, 116 QA, 121 C, 121 A, 121 F, 120 DD, 121 R; 15/415; 72/402; 220/67, 81 R, 379, 254, 258; 30/6, 17, 19, 310, 365; 83/7, 11, 12

[56] References Cited

U.S. PATENT DOCUMENTS

| | | | |
|---|---|---|---|
| 609,406 | 8/1898 | Brady | 30/19 |
| 1,335,233 | 3/1920 | Hammer | 113/121 R |
| 1,446,158 | 2/1923 | Clymer | 113/120 BB |
| 1,839,474 | 1/1932 | Gadd | 30/19 |
| 1,971,701 | 8/1934 | Bills | 30/310 |
| 2,175,411 | 10/1939 | Rheem | 113/120 BB |
| 2,196,877 | 4/1940 | Spengler | 113/121 A |
| 2,315,563 | 4/1943 | Taylor | 113/120 BB |
| 2,362,009 | 11/1944 | Hogg | 113/121 R |
| 2,523,285 | 9/1950 | Erb | 113/120 BB |
| 2,780,861 | 2/1957 | Sasser | 30/19 |
| 3,029,665 | 4/1962 | Baugh | 72/402 |
| 3,160,542 | 12/1964 | Foye | 220/67 |
| 3,175,553 | 3/1965 | Mattson | 128/2 F |
| 3,289,399 | 12/1966 | Princiotta | 15/415 |
| 3,424,148 | 1/1969 | Cadeillan | 128/276 |
| 3,505,722 | 4/1970 | Ullman | 220/67 |
| 3,513,829 | 5/1970 | Deuschle | 128/2 F |
| 3,603,132 | 9/1971 | Holmes | 72/402 |
| 3,740,824 | 6/1973 | Evans | 113/121 R |
| 3,881,254 | 5/1975 | Epstein | 128/276 |

FOREIGN PATENT DOCUMENTS

| | | | |
|---|---|---|---|
| 585,345 | 12/1924 | France | 113/121 C |

*Primary Examiner*—C.W. Lanham
*Assistant Examiner*—Gene P. Crosby
*Attorney, Agent, or Firm*—Hill, Gross, Simpson, Van Santen, Steadman, Chiara & Simpson

[57] ABSTRACT

A method and tools for forming a hermetically sealed container from a previously used can characterized by removing a portion of a top of a can radially inward of an inward edge of an annular depression of the top to form an opening, placing a continuous sealing member in the annular depression, assemblying a lid on a top with the lid having an annular shoulder for engaging the sealing member and an annular flange which has a reversed bend and extends from the shoulder over the rim to provide an annular skirt which extends along the outer surface of the rim and terminates therebelow, forcing the lid into sealing engagement with the sealing member, and while holding the lid in the sealing engagement, crimping the annular skirt beneath the rim to hold the lid in the sealing engagement. The tools include tools to facilitate removing the portion of the can lid by forming a tear circle or weakening line in the top of the can, a crimping tool which seats the lid in sealing engagement and holds it there while crimping the skirt into engagement with the rim, and an air removing device which is used when canning or sealing a liquid within the container to remove air entrapped between the depression and the side wall of the can.

19 Claims, 17 Drawing Figures

METHOD OF FORMING A HERMETICALLY SEALED CONTAINER AND THE TOOLS USED THEREWITH

BACKGROUND OF THE INVENTION

The present invention is directed to a method and tools for performing a method which method forms a hermetically sealed container from a previously used can.

In recent years the selling of beverages such as beer and soft drinks in throw away cans has increased. Many of these beverages are sold in cans which are provided with a top having an integral opening means which is easily opened to consume the contents. An example of such an integral opening means is a scored portion of the can which portion can be removed by pulling on a ring which is attached thereto.

With the increased popularity of these throw away cans, problems have arisen with their proper disposal. Due to such problems, various recycling centers have been suggested for collecting the cans for their scrap value. However, recycling the cans as scrap consumes large expenditures of energy and labor whose value often exceeds the value of the materials being recovered.

In recent years, due to a rising interest in home canning, canning supplies have been in great demand resulting in many shortages during the canning season. While the manufacturers of canning jars and lids have attempted to meet the increased demand, the demand has often exceeded the supply and has resulted in shortages of canning jars and lids in many areas.

SUMMARY OF THE INVENTION

The present invention is directed to a method and tools used in the method which enable forming a hermetically sealed container from a previously used can. The invention thus enables converting a used can, such as a beverage can having an integral opening means, into a useful device such as a sealed container, which is particularly useful in storing contents in a hermetically sealed condition such as desired for storage of food by freezing or home canning.

To accomplish this task, the method comprises providing a can having a continuous side wall with a bottom and a top attached thereto, said top having an annular portion crimped on the side wall to form a rim, an integral opening means, and an annular depression adjacent the rim, removing a portion of the top disposed inward of an inward edge of the annular depression to provide an opening surrounded by the annular depression, placing a continuous sealing member in the annular depression, assemblying a lid on the top, said lid having an annular shoulder for engaging the sealing member and an annular flange having a reversed bend, said flange extending from the shoulder over the rim and providing an annular skirt extending along the outer surface of the rim to terminate therebelow, forcing the lid in sealing engagement with the sealing member, and while holding the lid in sealing engagement, crimping the annular skirt beneath the rim to hold the lid in said sealing engagement.

To facilitate the removal of a portion of the top, the invention includes a tool for forming or creating a circular weakening groove of a given radius in the top of the can which groove is concentric with the rim joining the top to the side wall and of a smaller radius. The tool comprises a housing with at least one forming member extending from a surface on the circle of the given radius and guide means engaging said rim for positioning the housing member for relative movement on the top with said circle being concentric to said rim so that relative rotation of the tool under pressure on the top of the can forms the concentric weakening groove to enable removal of the portion of the top to form an opening which is concentric with the rim and with the edge of the opening radially spaced inward therefrom.

To crimp the flange of the lid as it is held in sealing engagement on the can, the invention includes a tool having a first member and a second member. The first member has a passage extending inward from one end, said passage having a surface with a cylindrical portion and a tapered portion converging from said one end to the cylindrical portion. The second member has a cylindrical outer surface slidably received in the cylindrical portion of the passage and a plurality of integral crimping fingers extending from one end of the second member and circumferentially spaced around the axis thereof. Each of the fingers has a free end with a radially extending abutment surface spaced axially inward therefrom and supports a radially inward directed forming surface between the abutment and free end so that as the first member and second member move axially relative to each other, the abutment surfaces force a lid into sealing engagement on the container and subsequently urges the fingers inwardly to crimp a portion of the lid on the container.

The lid, which coacts with the seal to form the new sealing engagement, has an annular shoulder of a diameter for engaging the sealing member and an annular flange which has a reversed bend and extends from the shoulder over the rim and provides an annular skirt extending along an outer surface of the rim to terminate therebelow. The annular skirt and the annular portion extending between a bight portion and an annular shoulder each slightly diverge from the bight portion so that fluid may escape over the rim as the lid is being moved into sealing engagement and until the sealing engagement is formed.

Due to the configuration of the beverage can, a space is formed between the side wall adjacent the rim and the annular depression in the previously applied top. During canning or packaging of certain items, air may be entrapped in this small space. To remove the entrapped air when canning contents having a liquid, the method includes prior to assemblying the new lid, filling the can with the liquid to a level above the opening and preferably between the opening in the top and the top of the rim, removing the air entrapped between the annular depression and the side wall of the can. To remove the air, the present invention provides an air removal tool having a suction means, and a nozzle with an inlet port and an outlet port which outlet port is connected to the suction means. The nozzle is a thin hollow tube with a reversed bend having a bight portion between the inlet port and the outlet port.

DESCRIPTION OF THE PREFERRED EMBODIMENTS

Figure 1:
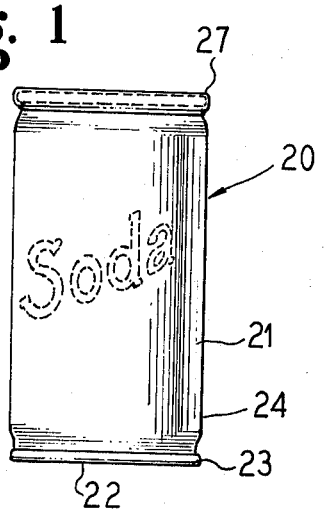
FIG. 1 is a side view of a hermetically sealed container formed from a previously used beverage can in accordance with the present invention.
Figure 2:
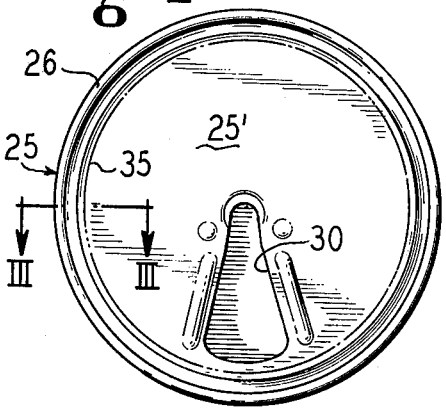
FIG. 2 is a top view of the top of a previously used beverage can.

The principles of the present invention are particularly useful for forming a hermetically sealed container generally indicated at 20 in FIG. 1. The container 20 utilizes a used can 21 such as a beverage can, which has a circular bottom 22 connected by a conventional rolled flange or rolled seam 23 to a side wall 24 and has a circular top or lid 25 (FIG. 2). The top 25 is attached by a rolled flange joint to the side wall 24 to form the rim 26. The hermetically sealed can, as illustrated in FIG. 1, includes a lid 27 which coacts with a sealing member 28 (FIG. 4) to hermetically seal the previously used can 21.

Figure 3:
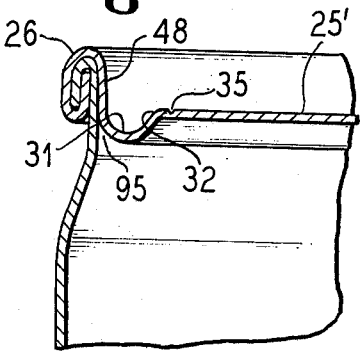
FIG. 3 is a partial cross section taken along lines III—III of FIG. 2.

The can 21 is a common beverage can with the top 25 which is usually aluminum and has integral means for opening. As illustrated, the top has an opening 30 which was formed by pulling or tearing away a portion of the top which was connected to a pull ring within score lines formed in the lid 25 prior to attachment to the side wall 25. As illustrated in FIG. 3, the majority of the portion of the top 25 is recessed axially from the upper surface of the rim 26 and has an annular groove or depression 31 which extends axially below a major portion of the top which contains the opening 30.

While the can 21 is illustrated in the drawings as having a slightly necked in side wall adjacent each rim 23 and 26, some cans have a cylindrical side wall with the top and bottom rims extending radially from the outer surface of the side wall. While the integral opening means was illustrated as being a pull tab type, other opening means such as a push button opening device are known in the art. Thus, the can 21 is an illustrative example of a used beverage can which may be hermetically sealed by the present invention.

Figure 4:
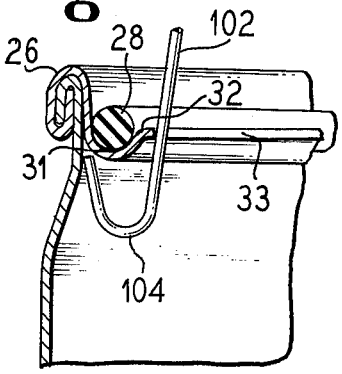
FIG. 4 is a partial cross section similar to FIG. 3 with a portion of the lid removed.

To practice the method of the present invention a portion 25' of the lid 25 which is disposed radially inward of an inner edge 32 of the annular depression 31 is removed by being torn or broken away to form an opening 33 (FIG. 4). When being formed many tops have a sharp radius at the inner edge 32 of the depression 31 and the sharp radius provides an inherently weakened circular path to facilitate removal of the portion 25'. However, some tops do not have a sufficiently sharp radius at the edge 32 to provide the weakened path to enable forming the opening 33. To facilitate the forming of the opening 33, the portion 25' can be manually depressed to increase the sharpness of the radius edge 32 and form the weakened line for removing the portion 25'.

Figure 5:
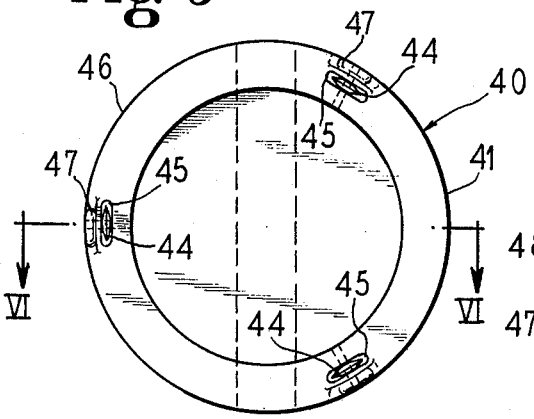
FIG. 5 is an end view of a tool for forming a circular weakening groove in accordance with the present invention.
Figure 6:
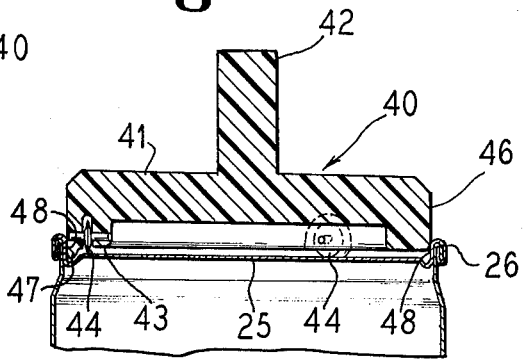
FIG. 6 is a cross section taken along lines VI—VI of FIG. 5 illustrating the tool disposed on the top of the can during forming the weakening groove.

While manually increasing the sharpness of the radius at edge 32 will enable removal of the portion 25', the invention contemplates providing a weakening groove or line 35 in the top 25. The line 35 is a circular groove of a desired diameter or radius that is concentric with the rim 26 and is either at the inner edge 32 or inwardly adjacent thereto. To form this groove, a tool generally indicated at 40 in FIGS. 5 and 6 can be utilized.

The tool 40 has a housing or body member 41 which may be a one-piece member with an integral handle 42. The member 41 on a surface 43 opposite the handle 42 is provided with three equally spaced forming members 44 which extend from the surface 43 on a circle of a given radius which is the desired radius of groove 35. As illustrated, the forming members 44 are thin circular members which are each mounted in a socket 45 for rotation on an axis which extends radially from the center of member 41. The tool 40 includes guide means which engage a portion of the rim 26 to position the members 44 to move in a path that is concentric with the rim 26 to ensure forming the groove 35 concentric with the rim 26. While the guide means may be the outer surface 46 of the member 41, it is illustrated as including a plurality of projections 47 extending from the surface 43 on a circle which is concentric with the circle on which the forming members 44 are mounted.

During the step of forming the groove 35, the guide means of the tool 40 engages an inner surface 48 of the rim 26 as the tool is pressed against the top 25 and rotated. The forming members, while under pressure, roll on a circular path on the top 25 and forms the groove 35. Due to the thinness of the members 44, they will engage only a narrow path and form the groove 35. Thus, rotation of the tool 40, as it is pressed against the aluminum top 25, will form the weakening groove 35 in the top which groove facilitates the breaking of the portion 25' from the top 25 to form the opening 33.

Figure 12:
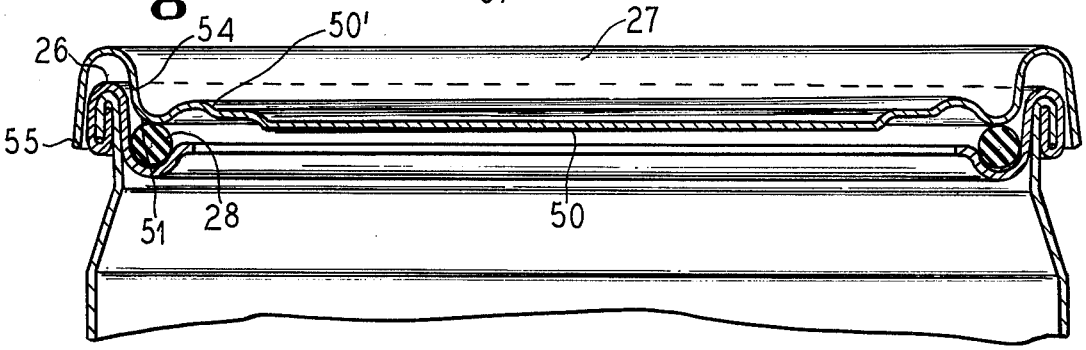
FIG. 12 is a partial cross section illustrating the assembly of the lid on the can prior to applying pressure and crimping.

After forming the opening 33, a sealing means or member such as 28 is placed in the depression 31. The sealing member 28 is illustrated as a standard rubber O-ring which has an inside and outside diameter selected to enable it to be received in the groove or depression 31 without any compression or stretching. The thickness of the O-ring is selected so that an upper surface extends above the inner edge 32 and above the opening 33, as illustrated in FIGS. 4 and 12, to receive the lid 27.

Figure 7:
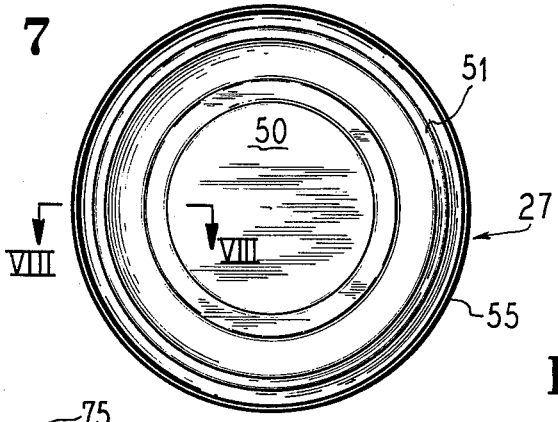
FIG. 7 is a plan view of a lid utilized in forming the hermetically sealed container in accordance with the present invention.
Figure 8:
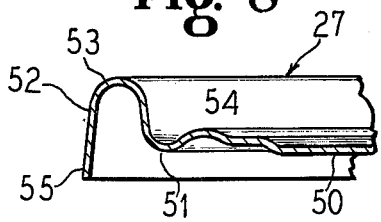
FIG. 8 is a partial cross section taken along lines VIII—VIII of FIG. 7.

The lid 27, which is best illustrated in FIGS. 7 and 8 and is made of aluminum, has a center circular portion 50 which has one or more annular corrugation and has an annular bead or corrugation to form an annular shoulder 51. Radial outward of the shoulder 51 is an integral annular flange 52. As best illustrated in FIG. 7, the flange 52 has a reversed bend with a bight portion 53 connected by an annular portion 54 to the shoulder 51 and separating the annular portion 54 from an outer annular skirt 55. The annular portion 54 extends from the shoulder 51 in an axial radially outward direction and, as illustrated, the skirt 55 extends at an axial direction and radially outward from the bight portion 53. Thus, the annular portion 54 and the skirt 55 have a slight divergence from the bight portion 53. The annular portion 54 has a length so that during a step of pressing of the shoulder 51 into sealing engagement with the sealing member or O-ring 28, the bight portion engages the rim 20 after the sealing engagement is formed. It is also noted that the axial distance of the annular skirt 55 is at least equal to or slightly greater than the axial dimensions of the annular portion 54.

After the contents have been placed in the used can 21, the lid 27 is assembled to cover the opening and the shoulder 51 rest on the sealing member 28. The next step of the method is to force the lid 27 into the tight sealing engagement with the O-ring 28 and while holding it in sealing engagement crimping the annular skirt 55 into crimping engagement with an outer portion of the rim 26.

Figure 9:
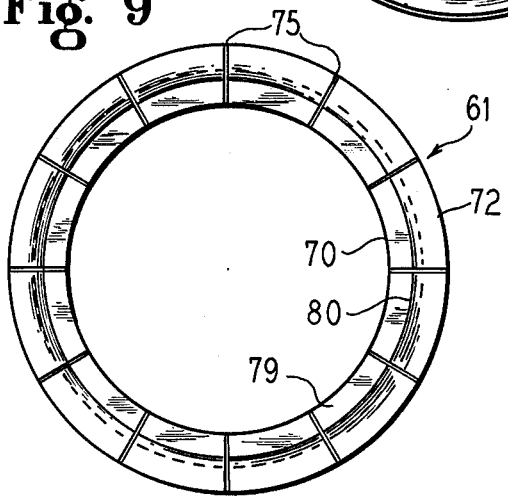
FIG. 9 is an end view of a member of a crimping tool utilized in the present invention.
Figure 10:
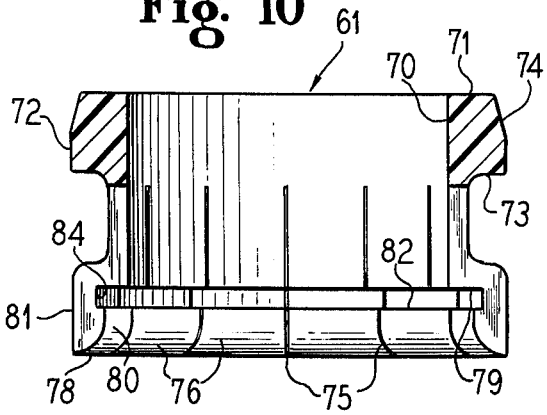
FIG. 10 is a cross section of the member of FIG. 9.
Figure 11:
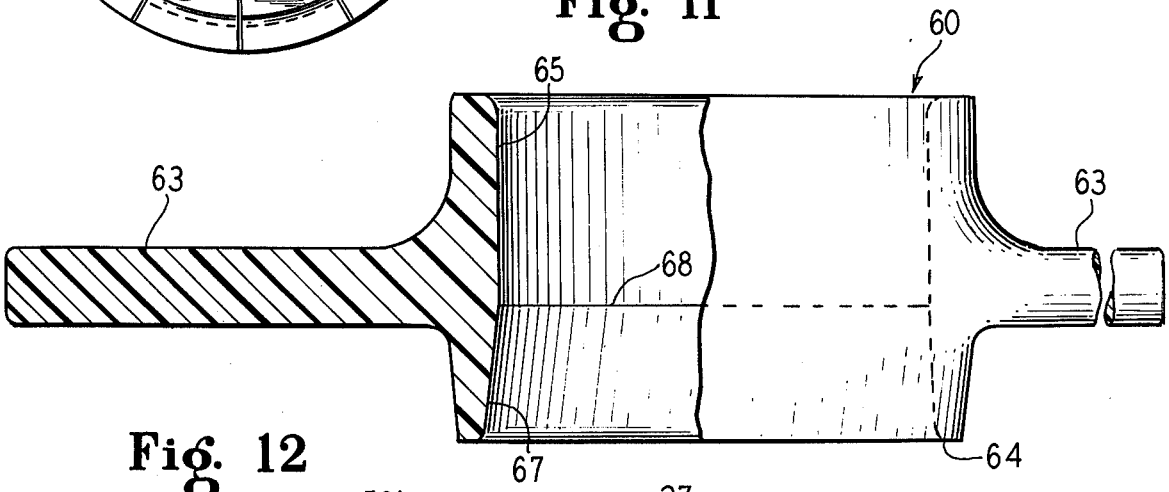
FIG. 11 is a partial cross section with portions in elevation of a second member of the crimping tool.

The present invention contemplates applying the pressure to form the sealing engagement and to crimp the skirt 55 with a tool comprising a first member 60 (FIG. 11) and a second member 61 (FIGS. 9 and 10). The first member 60 is a substantially cylindrical member having a pair of handles 63, 63 extending from an exterior surface. A passage extends from one end 64 and, as illustrated, axially through the member 60. The surface of the passage has a cylindrical portion 65 which is spaced inwardly from the end 64 of the member 60 and is joined with the end by a converging tapered portion 67 which merges with the portion 65 at a circular junction line 68. It is noted that while the passage has the tapered portion 67 merging at line 68, a second tapered shoulder may be provided at the junction line 68, if desired.

The second member 61 is a one-piece member having a cylindrical passageway 70, a top 71, and an outer cylindrical surface 72 which is divided into two axial sections by an annular groove 73 and which surface is of the same diameter as the cylindrical portion 65 of the first member 60. A tapered surface 74 is provided between the top surface 71 and the upper portion of the cylindrical surface 72. Opposite the upper surface 71, a plurality of circumferentially spaced slits or slots 75 extend inward from the other end to form a plurality of crimping fingers 76 which are circumferentially spaced around an axis of the member 61. Each of the fingers 76 has a free end 78 with a radial extending abutment or shoulder 79 axially spaced from the free end. Between the shoulder 79 and the free end 78 each finger has a forming surface 80 which is directed radial inward towards the axis of the member 61. As illustrated, each of the forming surfaces 80 diverge radially outward towards the free end 78 to provide a converging throat.

A lower portion 81 of the outer cylindrical surface 72 provides an outer cylindrical surface of the fingers 76 and the groove 73 enables the fingers 76 to be moved or deflected radially to the axis so the forming surfaces 80 can be moved radially with respect to the axis of the member 61. The second member 61 may be formed as an integral molded plastic part or machined from a single plastic member. Whether machined or molded, the abutment 79 of each of the fingers forms an annular radially extending pressure surface which is axially spaced from an upper edge 82 of each of the forming surfaces 80 to define an annular groove 84 of an axial length sufficient to receive the axial length of the rim 26 of the can 21 during the gripping operation.

After the lid 27 has been assembled on the top with the shoulder 51 engaging the O-ring 28 (FIG. 12), the second member 61 is then forced onto the lid 27 with the abutment surfaces 79 engaging the upper portion of the bight 53 of the flange 52 and the forming surfaces 80 engaging a lower portion of the skirt 55. The skirt 55 will deflect each of the fingers 76 outward (FIG. 13) so that the outer surface 81 has a greater diameter then it had in the relaxed state.

Figure 13:
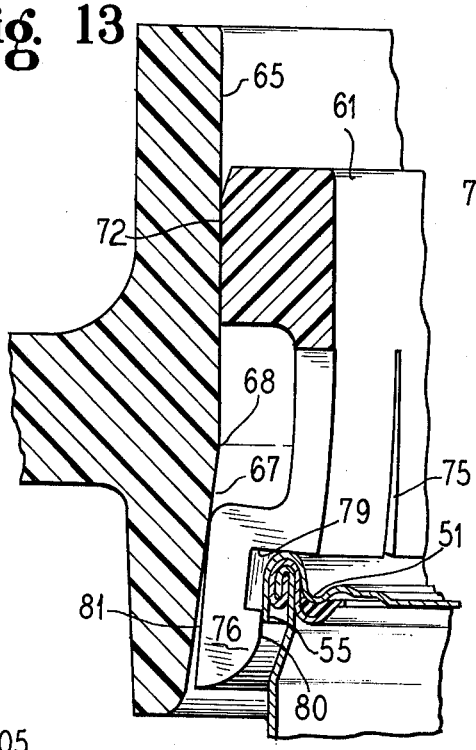
FIG. 13 is a partial cross section illustrating the application of pressure to form the seal between the lid and sealing member in accordance with the present invention.
Figure 14:
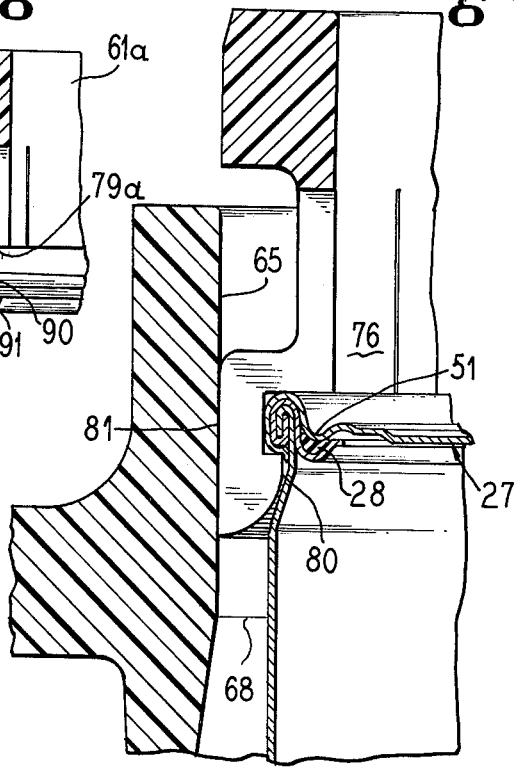
FIG. 14 is a partial cross section illustrating crimping the flange of the lid.

After placing the second member 61 on the assembled lid 27, the first member 60 is telescopically moved onto the second member with the tapered portion 67 receiving the upper portion and engaging either the tapered surface 74 and an upper portion of the surface 72. Axial movement of the member 60 on the member 61 applies an axial pressure on the member 61 so that as the surface 72 is received in the cylindrical portion 65 with a tight sliding fit, the lid 27 is forced into sealing engagement with the O-ring 28 which sealing engagement causes deforming of the O-ring. When in the sealing engagement, the bight portion 53 will be forced either into engagement with the top of the rim 28 as illustrated in FIG. 13 or close thereto. Continued movement of the member 60 axially on the member 61 holds the lid in the sealing engagement and as the outer surface 81 of each of the fingers 76 is moved along the tapered portion 67 to the cylindrical portion 65, they are urged in a radial inward direction with their forming surfaces 80 crimping the lower portion of the annular skirt 55 under the rim 26 as illustrated in FIG. 14 to complete the attachment of the lid 27 on the can 21. In this crimped condition, the lid 27 is held in sealing engagement on the O-ring 28 to form the hermetically sealed container 20.

Figure 15:
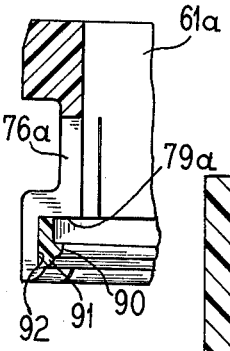
FIG. 15 is a partial cross section of an embodiment of the crimping tool illustrated in FIG. 10.

Due to the slots 75 in the member 61, the crimping of the material will cause forming creases or buckles in the crimped skirt 55. An embodiment **61*a* of the member 61 is illustrated in partial cross section in FIG. 15. The upper portion adjacent the upper surface is the same and the embodiment utilizes a continuous forming surface 90 which is provided as an inwardly directed annular bead on a ring 91 which is mounted in an annular groove 92 formed on an inner surface of the fingers 76*a*. As illustrated, the forming surface 90 formed by the bead is axially spaced from both the free end of each of the fingers 76*a* and the radial extending abutment 79*a*. The ring 91 is selected of a plastic material which has a high compressibility and which will elastically yield to receive the lid 27 as illustrated in FIG. 13**.

As the first member 60 is moved axially over the member **61*a*, the inward movement of the fingers 76*a* cause the forming surface 90 formed by the bead to crimp the skirt beneath the edge of the rim 26 of the can 21. The continuous forming surface 90 causes smoothing and ironing of the crimped metal skirt without producing the undesired creases of the device illustrated in FIG. 10. It should be pointed out that the continuous crimping without the creases will enable the container 20** to withstand higher internal pressures which may occur in certain uses as a hermetically sealed container.

While the hermetically sealed container 20 of FIG. 1 can be used in various applications such as protecting parts or material from atmospheric conditions, many applications involve filling the container with a contents which include a liquid such as a syrup or brine. As best illustrated in FIGS. 3 and 4, the annular depression 31 coacting with the side wall adjacent thereto provides an annular space 95 which will entrap air as a liquid is added to the container. In some instances, it is desirable to remove as much of the entrapped air as possible prior to applying and sealing the lid 27 onto the can 21 to form the hermetically sealed container 20.

Figure 16:
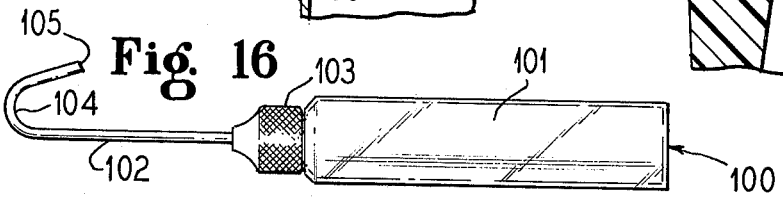
FIG. 16 is a side elevational view of a tool for removing air in accordance with the present invention.

To accomplish this, the invention includes an air removal device generally indicated at 100 in FIG. 16. The air removal or suction device 100 includes a suction means 101 which is illustrated as a flexible plastic tube which is connected to a suction nozzle 102. The nozzle 102 around an outlet port is provided with an enlarged housing or a member 103 which is sealingly received in the open end of the flexible tube 101. The nozzle 102 is a thin tube which has a reversed bend with a bight portion 104 separating an inlet port or open end 105 of the tube from the outlet port.

As best illustrated in FIG. 4, the reversed bend with a bight portion on the tube forming the nozzle 102 enables sucking out the air entrapped in the area 95 between the annular depression 31 and the side wall of the can. In order for this to occur, the liquid of the contents of the can is added to a level above the opening 33 and preferably to a level between the opening 33 and the upper edge of the flange 26. The nozzle 102 is placed in the can as illustrated in FIG. 4, the suction means is actuated to draw the entrapped air from the area 95 so that it may be replaced with a liquid in the can. With the tool as illustrated in FIG. 16, the plastic tube, which is preferably clear plastic, is collapsed prior to inserting the nozzle into the can and is released to create the suction. Once liquid is drawn into the plastic tube, the operator knows that either the majority or almost all of the air entrapped within the area 95 has been replaced by liquid.

Figure 17:
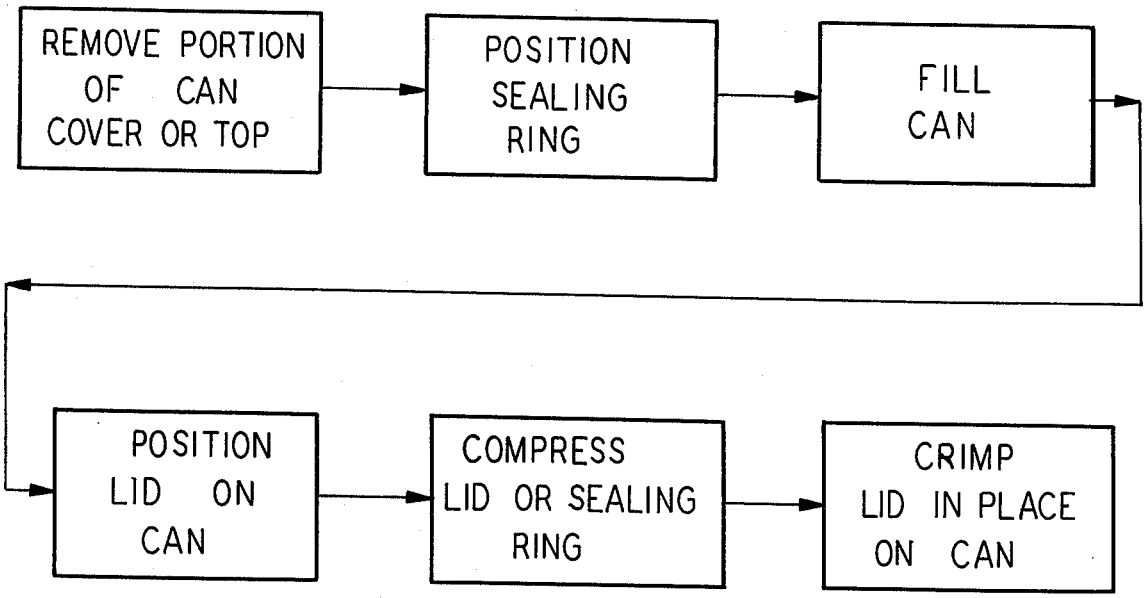
FIG. 17 is a flow chart for performing the method.

The method of hermetically sealing a previously used can is illustrated in the flow chart of FIG. 17. As illustrated, the method comprises removing a portion of the can cover or top, positioning a sealing ring, filling the can, positioning the lid on the can, compressing the lid on the sealing ring, and crimping the lid in place on the can to form the sealed container which can be opened by a conventional can opener. It is realized that the step of filling may be done prior to the step of positioning the sealing ring on the annular depression or groove 31. It is also realized that in most instances, the can will be cleaned and dried prior to filling with the contents and when handling items such as food, the method would include normal canning steps such as sterilizing the container. These steps of cleaning and sanitizing would probably be done immediately after removing the portion of the cover or top from the can.

As mentioned above, many of the beverage cans have an inherent weakened path formed by the sharp radius at the bend forming the annular depression 31 so that the step of removing the portion of the top radially inward of the groove merely requires tearing it out using some sort of tool such as a pair of pliers. However, some tops do not have a sufficiently sharp radius at the inner edge forming the groove 31 and additional manipulative steps are necessary. These steps can either be manually forcing the top downward to increase the sharpness of the bend or forming the weakening groove using the tool 40. Of course, it is contemplated that future cans may be initially manufactured with a weakening groove 35 to simplify reuse in accordance with this invention. Similarly, the tool 40 may be modified to provide scoring with a knife point or the like rather than roll forming.

When sealing either a liquid or a contents having a liquid in the can, problems with air entrapped in the space between the side wall and the annular groove may occur. To overcome this problem, the steps illustrated in FIG. 17 would include a modification of the step of filling the can to above the opening 33, and removing the air entrapped in the annular space 95.

As mentioned above, the annular flange 52 of the lid 27 has the skirt 55 and the annular portion 54 slightly diverging from the bight portion 53. This slightly diverging of the two portions connected by the bight portion facilitates assembly of the lid on the can. Also, in those instances of sealing a liquid or a contents containing a liquid in the can, the level of the liquid can be placed above the opening, the air in the portion 95 removed, and the lid applied on the can as illustrated in FIG. 12. With the liquid level extending above the opening, pressing of the lid into sealing engagement will force some air and liquid to move around the rim 26 until the sealing engagement is formed and the bight portion engages the top of the rim 26.

Although various minor modifications might be suggested by those versed in the art, it should be understood that I wish to employ within the scope of the patent granted hereon, all such modifications as reasonably and properly come within the scope of my contribution to the art.

I claim:

1. A method of forming a hermetically sealed container from a previously used can comprising the steps of providing a can having a continuous side wall with a bottom and a top attached thereto, said top having an annular portion crimped on the side wall to form a rim, an integral opening means, and an annular depression adjacent said rim, said annular depression having an inner edge spaced radially inward of the rim;

removing a portion of the top disposed radially inward of said inner edge of the annular depression to provide an opening surrounded by the annular depression;

placing a continuous sealing member in said annular depression;

assemblying a lid on the top, said lid having an annular shoulder for engaging the sealing member and an annular flange having a reversed bend, said flange extending from the shoulder over the rim and providing an annular skirt extending along an outer surface of the rim to terminate therebelow;

forcing the lid into sealing engagement with the sealing member; and while holding the lid in sealing engagement, crimping the annular skirt radially inward beneath the rim to hold the lid in said sealing engagement.

2. A method according to claim 1, wherein said step of removing includes forming a circular weakening groove in the top, said groove having a given radius less than the radius of said inner edge of the annular depression and being concentric with the rim.

3. A method according to claim 2, wherein said step of forming the circular weakening groove includes providing a tool having a housing member, a plurality of forming members extending from a surface of said housing member on a circle of said given radius, and guide means engaging said rim for positioning said housing member for relative movement on said top with said circle being concentric to said rim, and rotating the tool under pressure relative to the top to form the circular weakening groove in the top.

4. A method according to claim 1, which includes the step of placing contents within the can prior to the step of assemblying the lid on the top.

5. A method according to claim 4, wherein the step of placing contents in the can includes filling the can with liquid to a level between the depression and rim, removing air entrapped in the can between the annular depression and the side wall of the can.

6. A method according to claim 1, wherein the steps of forcing the lid into sealing engagement and crimping an annular skirt include providing a crimping tool having a first member and a second member, said first member having a passage extending inward from one end, said passage having a surface with a cylindrical portion and a taper portion converging from said one end to the cylindrical portion, said second member having a cylindrical outer surface slidably received in the cylindrical portion of the passage, said second member having a plurality of integral crimping fingers extending from one end of the second member and circumferentially spaced around the axis thereof, each of said fingers having a free end with a radially extending abutment spaced axially inward therefrom and supports a radially inward directed forming surface between the abutment surface and free end; positioning the second member with the abutment surfaces of the plurality of fingers engaging an upper surface of the annular flange of the lid; axially moving the first member on the second member to force the lid into sealing engagement and continuing the axial moving to force the crimping fingers inward to crimp the annular skirt beneath the rim.

7. A tool for creating a circular weakening groove of a given radius in a top of a can which groove is concentric with a rim joining the top to a side wall of the can and of a smaller radius, said tool consisting of a housing member, at least one forming member extending from a surface of said housing member on a first circle of said given radius, and guiding means having at least two points on a second circle concentric with said first circle for engaging an inner surface of said rim for positioning said housing member for relative movement on said top with said first circle being concentric to said rim so that relative rotation of said housing member under pressure on said top forms a concentric weakening groove to enable removal of a portion of the top to form an opening in the top concentric with the rim and with an edge spaced radially inward therefrom.

8. A tool according to claim 7, wherein said guide means comprises a plurality of projections circumferentially spaced on the second circle.

9. A tool according to claim 7, wherein at least one forming member comprises a plurality of circular forming members circumferentially spaced on said first circle of a given radius and mounted for rotation in said housing member about axes radial of said first circle.

10. A crimping tool for attaching a lid in sealing engagement on a container comprising a first member; and a second member, said first member having a passage extending inward from one end, said passage having a surface with a cylindrical portion and a tapered portion converging from said one end to the cylindrical portion; said second member having a cylindrical outer surface slidably received in the cylindrical portion of the passage, said second member having a plurality of integral crimping fingers extending from one end of the second member and circumferentially spaced around the axis thereof, each of said fingers having a free end with a radially extending abutment spaced axially inward therefrom and supports a radially inward directed forming surface between the abutment and free end whereby relative axial movement of the first member to the second member applies a force to seat a lid in sealing engagement on a container and subsequently urges the fingers to inwardly crimp a portion of the lid on the container.

11. A crimping tool according to claim 10, wherein each of the fingers has a curved outer surface coacting with the other fingers to form an axial continuation of the cylindrical surface of the second member when the fingers are in a relaxed state.

12. A crimping tool according to claim 10, wherein the forming surface supported on each finger is an inwardly directed integral projection on the finger.

13. A crimping tool according to claim 10, wherein said forming surfaces are provided by a continuous annular surface disposed on a partly compressible annular member, and each of said fingers has means for supporting said annular member coaxially in said second member.

14. A lid coacting with a sealing member supported on an annular portion of a top of a container beneath a rim of said container, said lid having an annular bead to provide an annular shoulder for engaging the sealing member and an annular flange radially outward of the shoulder, said flange extending axially away from the shoulder to a reversed bend and then in an opposite axial direction to provide an axially extending annular skirt extending past said shoulder so that when assembled on the container the annular shoulder engages the sealing member and the flange extends from the shoulder over the rim with the annular skirt extending along the outer surface of the rim to terminate therebelow.

15. A lid according to claim 14, wherein the annular flange has a U-shaped cross section with a bight portion interconnecting the annular skirt to an annular portion extending to the annular shoulder, said annular portion having sufficient length to enable forcing the annular shoulder into sealing engagement as the bight portion engages the top of the rim.

16. A lid according to claim 15, wherein the annular skirt and the annular portion slightly diverge from the bight portion so that during forcing of the lid into sealing engagement, fluids are able to escape over the rim until the sealing engagement is formed.

17. A lid and seal arrangement for use in forming a hermetically sealed container from a can having an annular depression surrounding an opening and spaced radially inward of a rim, said combination including a continuous annular sealing member of a diameter to be received in the annular depression, and a lid having an annular shoulder of said diameter for engaging the sealing member with an annular flange extending therefrom, said flange having a reverse bend and extending from the annular shoulder axially and radially outward therefrom to a bight portion and then radially downward to provide an annular skirt so that when the lid is assembled on the container, the annular skirt extends along an outer surface of the rim.

18. A method of forming a hermetically sealed container from a previously used can comprising the steps of providing a can having a continuous side wall with a bottom and a top attached thereto, said top having an annular portion crimped on the side wall to form a rim, an integral opening means, and an annular depression adjacent said rim, said annular depression having an inner edge spaced radially inward of the rim;

removing a portion of the top disposed radially inward of said inner edge of the annular depression to provide an opening surrounded by the annular depression;

assemblying a lid and a continuous annular sealing means on the top with the sealing means engaging an outer surface of the annular depression, said lid having an annular shoulder for holding the sealing means on the outer surface of the annular depression and an annular flange having a reversed bend, said flange extending from the shoulder over the rim and providing an annular skirt extending along an outer surface of the rim to terminate therebelow;

forcing the lid and sealing means into sealing engagement with the outer surface of the annular depression; and while holding the lid and sealing means in sealing engagement, crimping the annular skirt radially inward beneath the rim to hold the lid and sealing means in said sealing engagement.

19. A crimping tool for attaching a lid in sealing engagement on a container comprising a first member; and a second member, said first member having a passage extending inward from one end, said second member having an outer surface slidably received in the passage, said second member having a plurality of integral crimping fingers extending from one end of the second member and circumferentially spaced around the axis thereof, each of said fingers having a free end with a radially extending abutment spaced axially inward therefrom and a radially inwardly directed forming surface between the abutment and free end whereby relative axial movement of the first member to the second member applies a force to seat a lid in sealing engagement on a container and subsequently urges the fingers to inwardly crimp a portion of the lid on the container.

* * * * *